US009309101B2

(12) United States Patent
Krulitsch

(10) Patent No.: US 9,309,101 B2
(45) Date of Patent: Apr. 12, 2016

(54) BEVERAGE BOTTLING PLANT FOR FILLING BOTTLES WITH A LIQUID BEVERAGE MATERIAL HAVING A FILLING MACHINE

(75) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1372 days.

(21) Appl. No.: 12/635,292

(22) Filed: Dec. 10, 2009

(65) Prior Publication Data

US 2010/0083613 A1 Apr. 8, 2010

Related U.S. Application Data

(63) Continuation of application No. 11/122,270, filed on May 4, 2005, now abandoned.

(30) Foreign Application Priority Data

May 5, 2004 (DE) ..... 10 2004 022 096

(51) Int. Cl.
*B65B 61/00* (2006.01)
*B67C 3/26* (2006.01)

(52) U.S. Cl.
CPC ..... *B67C 3/2614* (2013.01); *B67C 2003/2645* (2013.01); *B67C 2003/2677* (2013.01)

(58) Field of Classification Search
CPC ..... B67C 3/2614; B67C 2003/2645; B67C 2003/2677
USPC ..... 53/281, 52, 84, 87, 91, 111 R, 253, 53/331.5, 317, 319, 136.1, 428, 431
See application file for complete search history.

(56) References Cited

U.S. PATENT DOCUMENTS

| | | | | |
|---|---|---|---|---|
| 3,018,804 | A | 1/1962 | Granier | |
| 3,799,219 | A | 3/1974 | Uth et al. | |
| 5,713,403 | A * | 2/1998 | Clusserath et al. | 141/101 |
| 6,607,768 | B1 * | 8/2003 | Eichner | 426/466 |
| 2005/0211332 | A1 | 9/2005 | Krulitsch | |

FOREIGN PATENT DOCUMENTS

| | | |
|---|---|---|
| DE | 1 122 394 | 1/1962 |
| DE | 1 632 004 | 11/1969 |
| DE | 1 607 985 | 8/1970 |

(Continued)

OTHER PUBLICATIONS

European Patent Office Search Report EP05 00 7358 and English translation thereof.

*Primary Examiner* — Sameh Tawfik
(74) *Attorney, Agent, or Firm* — Nils H. Ljungman & Associates

(57) ABSTRACT

A container filling machine filling valve arrangement for use in filling machines for filling containers, such as bottles, cans, or similar containers, with a liquid. The valve arrangement comprises a valve and an always-open gas cutoff element. The valve controls the flow of liquid from a liquid source into a container to be filled. The gas cutoff element is configured to: permit flow of liquid through the gas cutoff element, prevent or minimize gas from flowing through the gas cutoff element, and generate a swirling of liquid flowing through the gas cutoff element. The gas cutoff element is a substantially flat, planar element.

20 Claims, 19 Drawing Sheets

(56) References Cited

FOREIGN PATENT DOCUMENTS

| | | | |
|---|---|---|---|
| DE | 24 28 553 | A | 2/1975 |
| DE | 78 11 788 | U | 8/1978 |
| DE | 41 40 524 | C | 6/1996 |
| DE | 10 2004 013 211 | A1 | 9/2005 |
| EP | 0 546 346 | A | 6/1993 |

* cited by examiner

BEVERAGE BOTTLING PLANT FOR FILLING BOTTLES WITH A LIQUID BEVERAGE MATERIAL HAVING A FILLING MACHINE

CONTINUING APPLICATION DATA

This application is a Continuation of co-pending U.S. patent application Ser. No. 11/122,270, filed on May 4, 2005.

BACKGROUND

1. Technical Field

The present application relates to a beverage bottling plant for filling bottles with a liquid beverage material having a filling machine for filling bottles, cans and similar containers as described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Filling valves of the prior art are equipped with gas cutoffs or gas locks. Filling valves with gas cutoffs are primarily used for the bottling of carbonated liquids that are introduced from a pressure vessel into a bottle that is connected with the filling mechanism. In the prior art, before the actual filling begins, the pressure between the bottle and the pressure vessel must be equalized so that the liquid can flow into the bottle as a result of hydrostatic pressure. During this process, the counter-pressure gas in the bottle is pushed back into the actual gas headspace of the filling bowl and is replaced by the liquid. For this purpose there is a return gas tube 11 which, with its bottom end surface, defines the boundary of the actual filling process, as soon as the liquid has reached said end surface.

Consequently, a further escape of the gas back into the pressure vessel is no longer possible. On such filling mechanisms there is a risk that the quantity of gas that is above the surface of the liquid will bubble up through the liquid duct, which is still open, and will thereby cause an after-running of the liquid that is above the valve seat. This situation can be effectively prevented by a gas cutoff that is located above the valve seat, for example.

On filling valves in which the filling level is determined essentially by a return gas tube 11, it is absolutely necessary to prevent the liquid flowing into the container from adhering to said return gas tube and to prevent it from flowing along said return gas tube 11 into the container to be filled. If the liquid should flow along the return gas tube 11 into the container, there is a risk that drops of liquid that adhere to the lower end of the return gas tube 11 can be carried along by the pre-pressurization gas that is flowing through the return gas 11 out of the container and accumulate inside the return gas tube 11, for example, as a result of which they can lead to a "sputtering" of the return gas tube 11 and ultimately to a disruption of the filling process.

To reliably prevent this situation, it has been known for some time that guide elements for the liquid, generally devices that are called screens or shields 16 can be located on the external contour of the return gas tube 11 that deflect the liquid far above the lower end of the return gas tube 11 and steer it toward the container wall. Because such return gas tubes 11 equipped with a screen 16 are expensive to manufacture, and as a rule must be changed depending on the model of bottle being used, many attempts have been made in the past to replace the screens 16 with other components. For example, in similar devices of the prior art, swirl inserts or torsion bodies have been located inside the liquid path which impart a rotational motion to the liquid, as a result of which the liquid flows into the container in contact with the inside wall of the container.

Because the use of gas cutoffs and swirl inserts or the use of gas cutoffs and return gas tubes with screens must be considered disadvantageous on account of the high costs of manufacturing, installation and maintenance, attempts have been made to combine gas cutoffs and swirl inserts.

For example, DE 41 40 524 C2 describes a thin, bell-shaped gas cutoff that can be manufactured in the form of a stamped sheet metal part, for example, in which the holes that run through said bell are oriented tangentially, so that a rotational motion is imposed on the liquid that flows through these openings.

The principal disadvantage of this device described in the prior art is that the material thickness of the bell is comparatively low. This low thickness is a disadvantage because the material thickness is equivalent to the length over which the liquid is guided, the purpose of which is to impose a rotational motion on the incoming liquid which has an essentially diffuse flow. The short length of the guidance therefore means that the new velocity vector, which comprises direction and velocity, can only be realized incompletely, especially since the liquid flows into the container only as a result of the hydrostatic pressure.

It is further disadvantageous that the bell shape of the gas cutoff requires a double deflection of the liquid, as a result of which the filling speed of the liquid is disadvantageously influenced. A gas cutoff of this type, on account of its large dimensions, also requires a great deal of space in the vertical direction, which is likewise disadvantageous for cost reasons and on account of the small amount of space available.

A comparable device was described in German Utility Model 78 11 788, in which the gas cutoff comprises an element that is in the shape of a truncated cone, the lower edge of which is formed by a comb-like structure. The slots in said comb-like structure are thereby realized so that they impart a centrifugal acceleration to the liquid as it flows into them.

Theoretically, the disadvantages cited above also apply to the device described by Utility Model 78 11 788. The manufacture of the comb-like structure described above is also very complex and expensive.

OBJECT OR OBJECTS

The object is to substantially eliminate or minimize the effects of the disadvantages described above. For this purpose the present application teaches a filling valve that is equipped with a gas cutoff with a swirling action, whereby the gas cutoff is realized essentially in the form of a flat element.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is described in greater detail below on the basis of an exemplary embodiment which is illustrated in the accompanying drawings.

FIG. 11 shows a side cross sectional view of the gas cutoff according to another possible embodiment;

DESCRIPTION OF EMBODIMENT OR EMBODIMENTS

Developments, advantages and potential applications of the present application are described in greater detail below with reference to exemplary embodiments and the accompanying drawings. All the characteristics described and/or indicated in the illustrations, individually or in any arbitrary combination, are thereby the object of the present application, regardless of their placement in the claims or the cross-references among the claims. The text of the claims is also hereby incorporated by reference into this description.

Figure 1:
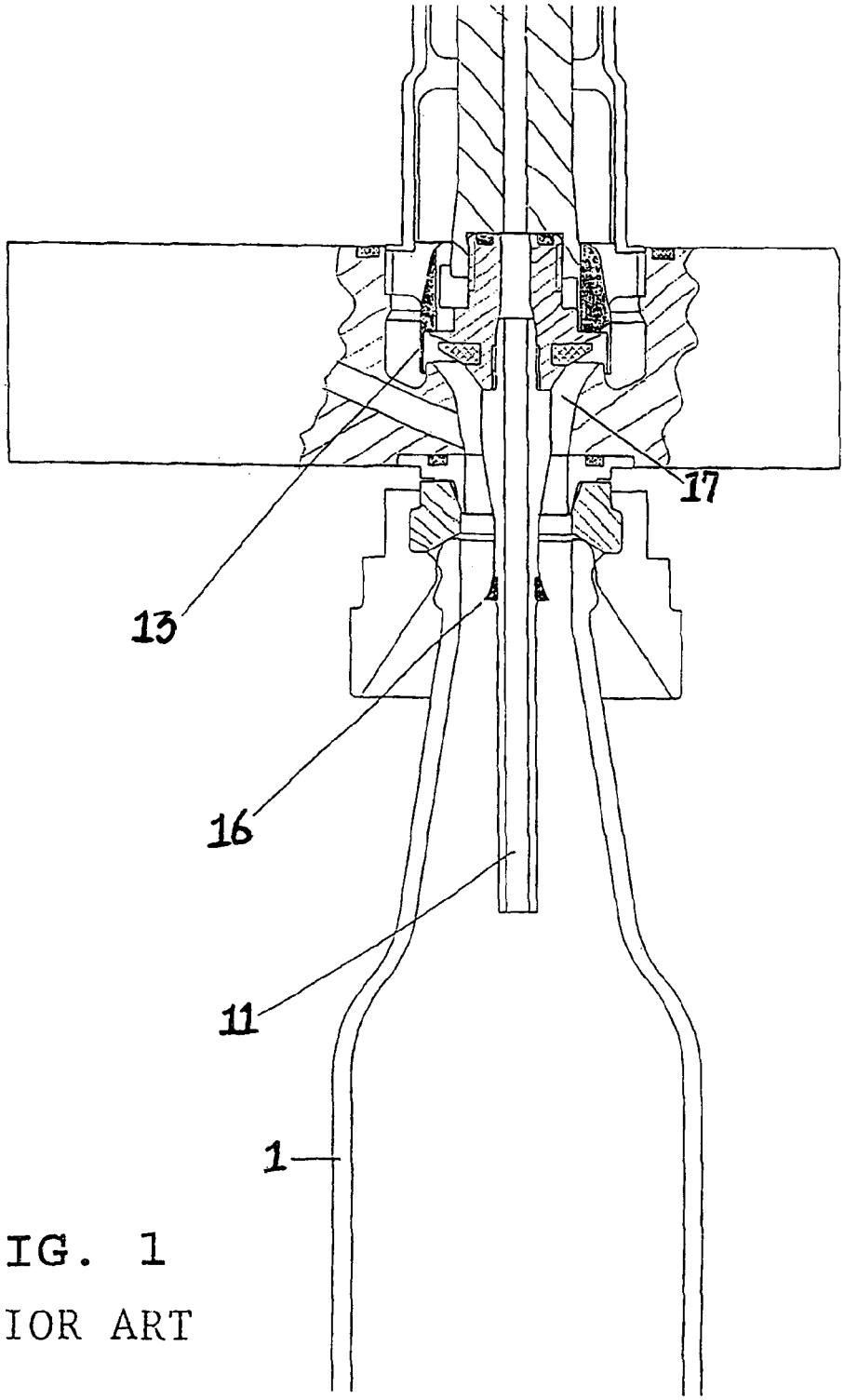
FIG. 1 PRIOR ART
FIG. 1 shows a filling valve of the prior art with a gas cutoff of the prior art.
Figure 1A:
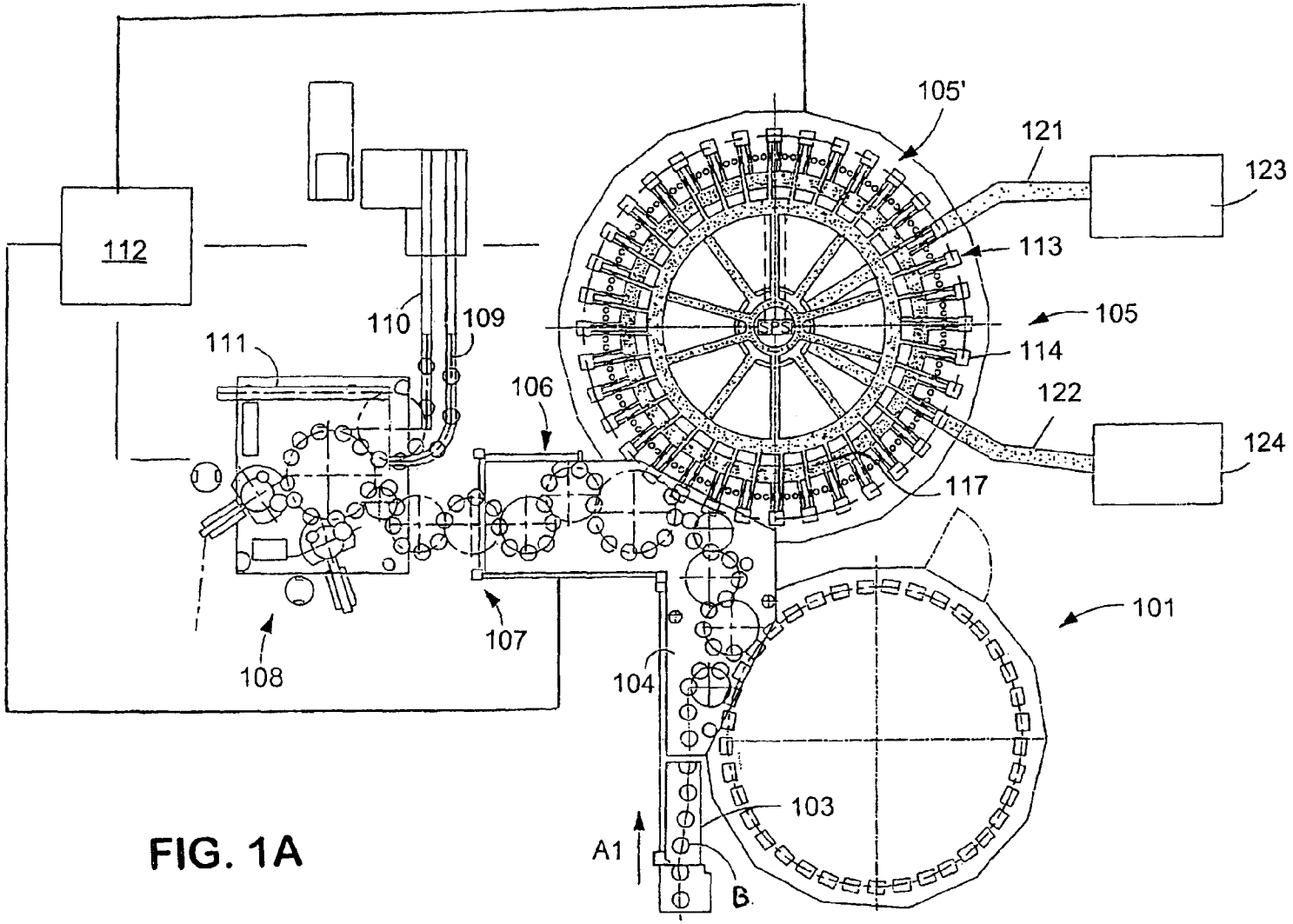
FIG. 1A is a schematic illustration of a beverage bottling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

FIG. 1 shows a filling device of the prior art as discussed herein.

Figure 2:
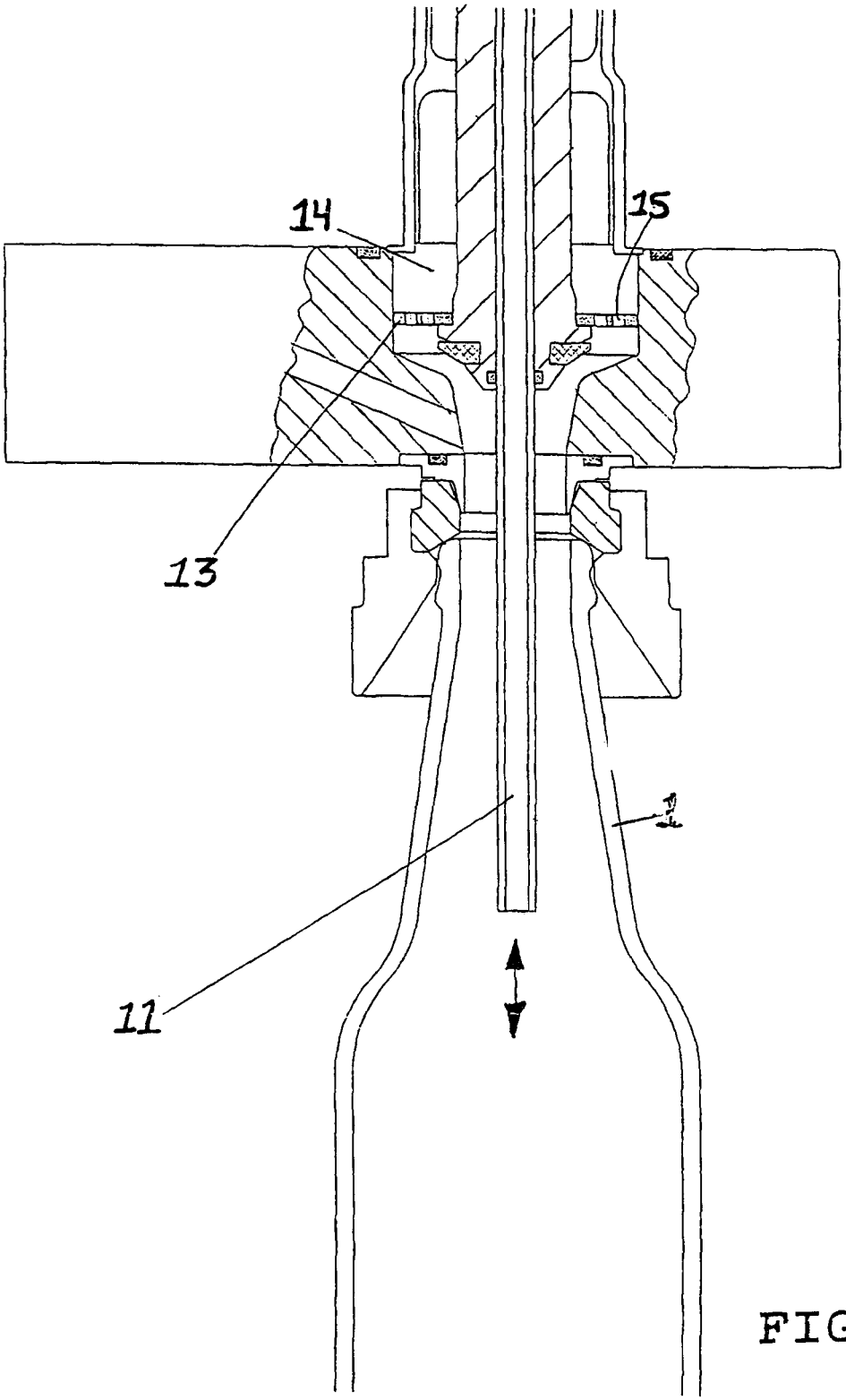
FIG. 2 shows a filling valve as taught by the present application with a modified gas cutoff.

As shown in FIG. 2, the present application teaches that the gas cutoff with a swirl effect 13 can be realized in the form of a flat, plane element, as a result of which the multiple sharp deflection of the liquid required in the devices of the prior art is eliminated.

The gas cutoff 13 contains a plurality of passages 15, each of which represents a connection between the upper side and the underside of the gas cutoff 13.

In an additional advantageous realization, the present application teaches that in addition or also exclusively, there are recesses, e.g. fin-shaped recesses, which at least partly interrupt the radial outer contour/the peripheral surface of the gas cutoff 13.

Passages 15 and/or recesses and/or their side walls have an inclination with respect to the vertical, so that the liquid flowing through them takes on a velocity vector which contains, among other things, a velocity component in the peripheral direction with respect to the valve axis. As a result of this velocity component, a rotational movement of the liquid is realized, as a result of which the liquid, during its further travel, comes into contact first with the inside wall of the filler valve and, as it flows into the container 1, with its inner wall.

For the inclination of the passages 15 and/or recesses 15, the present application teaches that said inclination first runs in the peripheral direction. The present application also teaches that the inclination is realized as a function of the location where the filling machine is to be used, so that the effect of the Coriolis force that occurs during these flow processes is utilized and/or positively assisted.

On filling machines that are designed to be used in the earth's Northern Hemisphere, the inclination should be such that the liquid rotates in the clockwise direction, viewed in the direction of the flow. The opposite applies for filling machines that are designed to be used in the Southern Hemisphere.

The present application also teaches that the passages can also be inclined in the radial direction, so that the liquid is additionally guided toward the inside walls of the filling valve and container 1.

For the realization of the passages 15 and/or recesses, this embodiment teaches that said passages and/or recesses can be round, oval, square, rectangular, polygonal or elliptical, or realized in any other desired shape.

The present application also teaches that the profile of the passages 15 or of the recesses can be linear as well as non-linear, in other words the profile of the passages 15 can also be curved.

In an additional, altogether advantageous development of the present application, the parameters of the gas cutoff 13 such as, for example, its thickness, size of the passages 15 or recesses and their inclination can be customized to the specific characteristics of the liquid being bottled, such as its viscosity or surface tension, so that the characteristics of the gas cutoff 13 such as gas-tightness, swirling action and filling capacity can be optimally coordinated with one another. This system coordination is naturally also and in particular appropriate when a plurality of liquids are to be processed in alternation with a single filling machine.

As a result of the advantageous configuration of the installation space 14 for the gas cutoff 13, it is possible without problems or substantial effort to use gas cutoffs 13 of different thicknesses.

In an additional advantageous development of this invention, which is predominantly but not exclusively suitable for the bottling of beverages containing fruit pulp, for example, the present application teaches that the gas cutoff 13 can be realized with a funnel-shaped or cone-shaped upper side, analogous to one or more embodiments disclosed in an additional application by the same applicant, specifically U.S. application Ser. No. 11/0 82,236 filed Mar. 16, 2005, which application is incorporated by reference herein. As a result of this particularly shaped upper side, a self-cleaning action of the gas cutoff 13 is carried out during the bottling of beverages that contain fruit pulp.

The size, shape, angle, diametrical dimension, cross section, and contour of the passages 15 are configured to take into effect the Coriolis force for the latitude of the bottling plant location, the viscosity of the fluid being bottled, the amount and size of pulp in the fluid, and the temperature of the fluid being bottled. Further, the passages 15 are designed to minimize gas bubbling back up through the passages 15 upon a bottle being filled, to substantially prevent liquid beverage from coming into contact with the return gas tube in order to prevent drops of liquid from entering the return gas tube during the evacuation of gas from a bottle being filled, and to minimize filling time. Each element of the design of the passages 15 may be determined by experimentation with different types of fluids, such as fluids with different viscosities or varying amounts of pulp.

Figure 3:
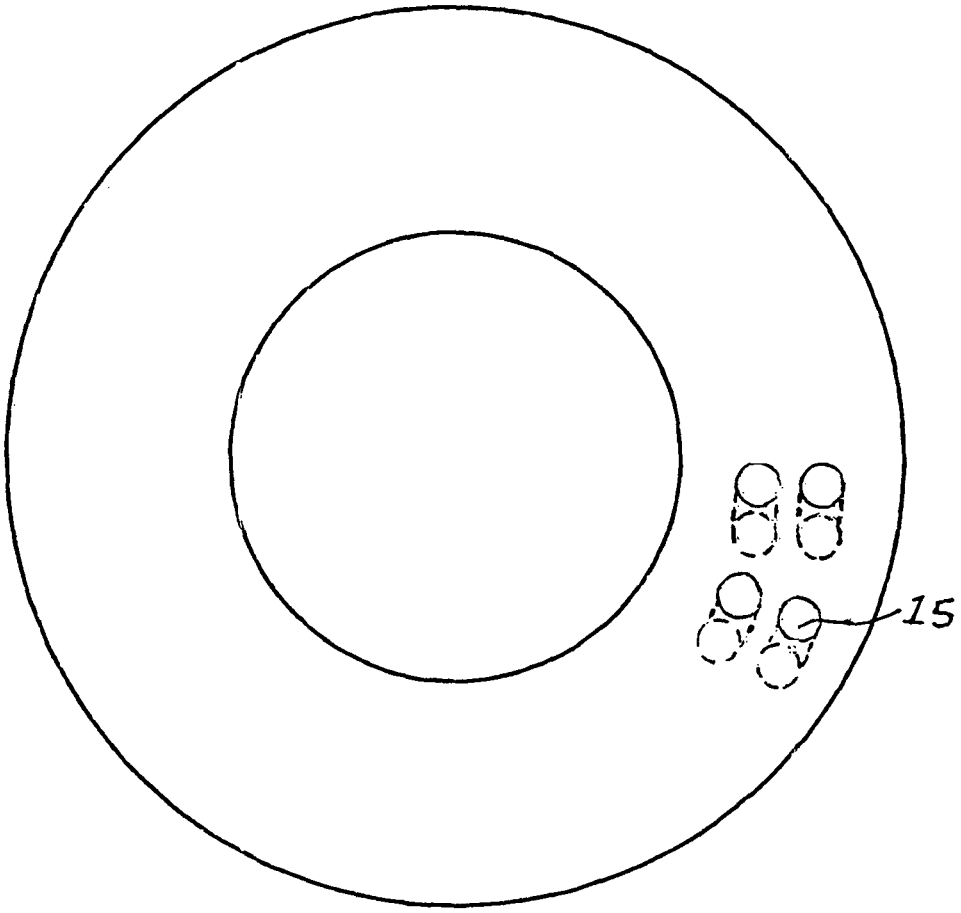
FIG. 3 shows a top view of the gas cutoff according to one possible embodiment.

FIG. 3 shows a top view of one possible embodiment of the gas cutoff 13. According to this possible embodiment, the passages 15 comprise a circular open top end and a circular open bottom end, as well as a cylindrical inner wall portion through which a liquid beverage can flow. The open top end is offset from the open bottom end to permit the flow of liquid beverage in a circular or swirling motion in order to guide the liquid beverage toward the inside walls of the filling valve and container 1. In this embodiment, the passages 15 are disposed radially and concentrically about the gas cutoff 13. FIG. 3 shows two sets of passages for illustrative purposes, and it is to be understood that any number of additional passages could be included in different possible embodiments. In at least one embodiment, the passages as shown in FIG. 3 could continue about the entirety of the gas cutoff.

Figure 4:
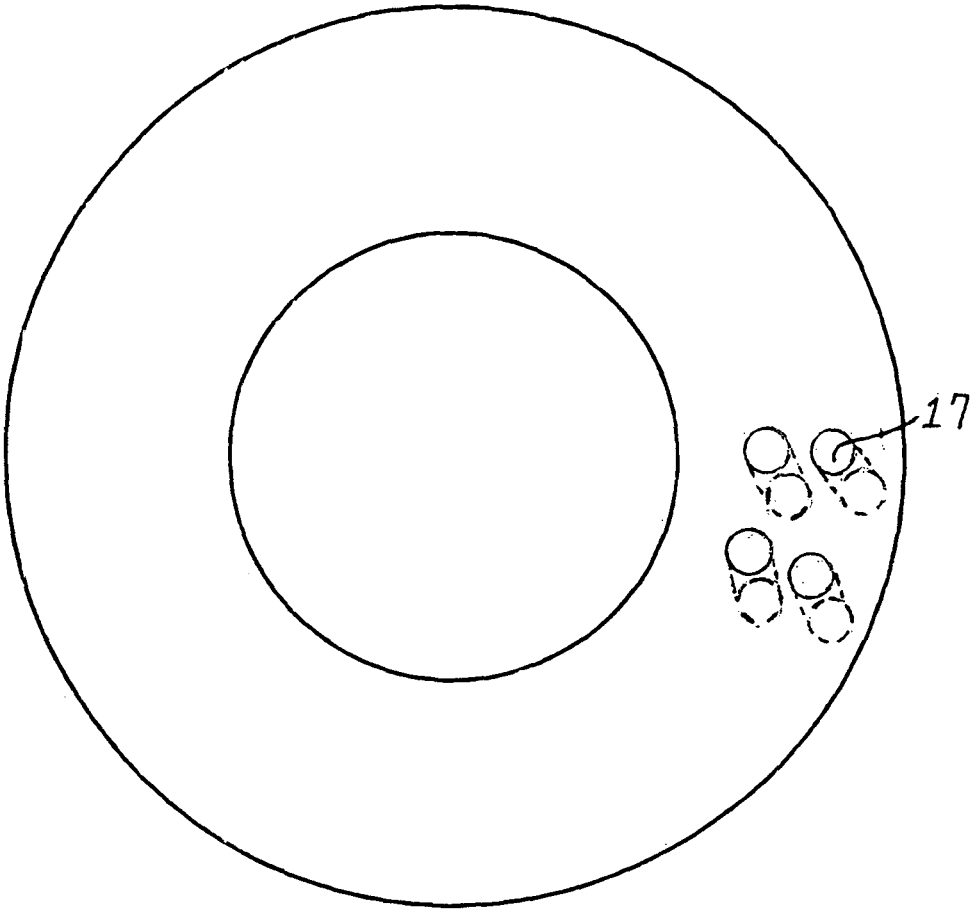
FIG. 4 shows a top view of the gas cutoff according to another possible embodiment.

FIG. 4 shows a top view of another possible embodiment of the gas cutoff 13. In this possible embodiment, the passages 17 are offset diagonally such that they are pointed radially outward in order to further direct liquid beverage toward the inside walls of the filling valve and container 1. FIG. 4 shows two sets of passages for illustrative purposes, and it is to be understood that any number of additional passages could be included in different possible embodiments. In at least one embodiment, the passages as shown in FIG. 4 could continue about the entirety of the gas cutoff.

Figure 5:
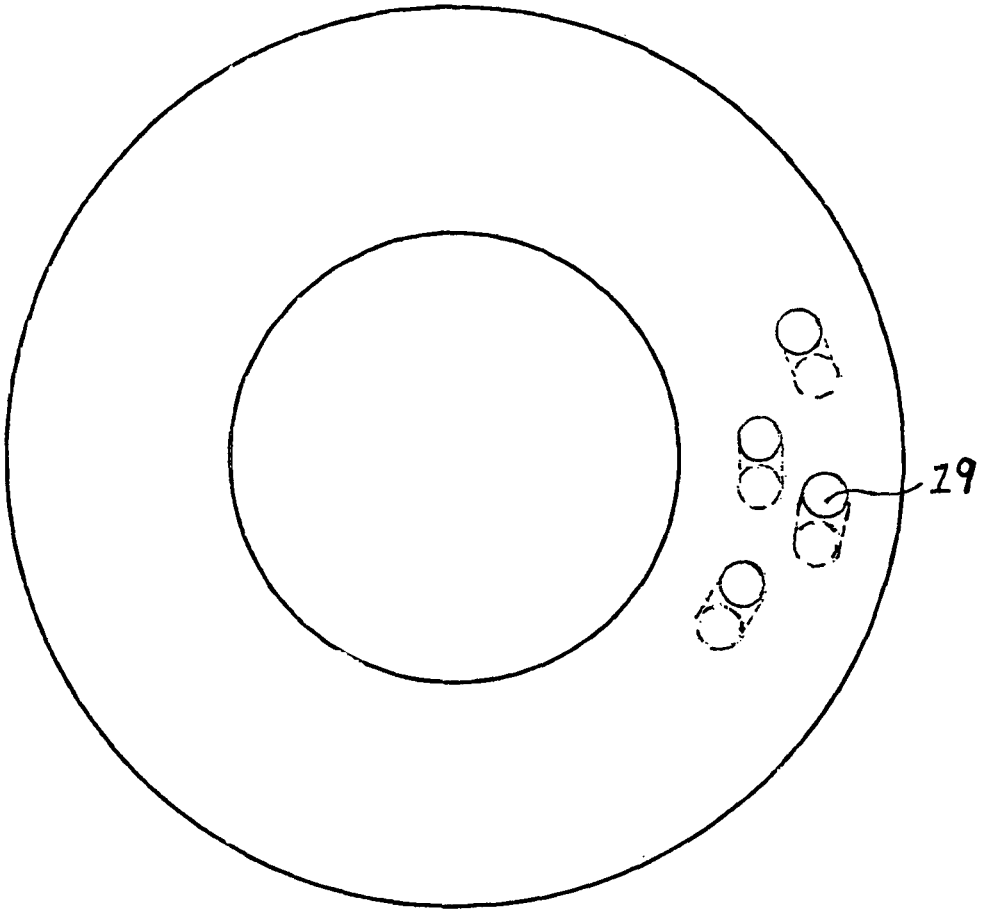
FIG. 5 shows a top view of the gas cutoff according to yet another possible embodiment.

FIG. 5 shows a top view of another possible embodiment of the gas cutoff 13. In this possible embodiment, the outer and inner passages 19 are staggered with respect to one another about the gas cutoff 13, rather than being disposed radially, as shown in FIGS. 3 and 4. FIG. 5 shows two sets of passages for illustrative purposes, and it is to be understood that any number of additional passages could be included in different possible embodiments. In at least one embodiment, the passages as shown in FIG. 5 could continue about the entirety of the gas cutoff.

Figure 6:
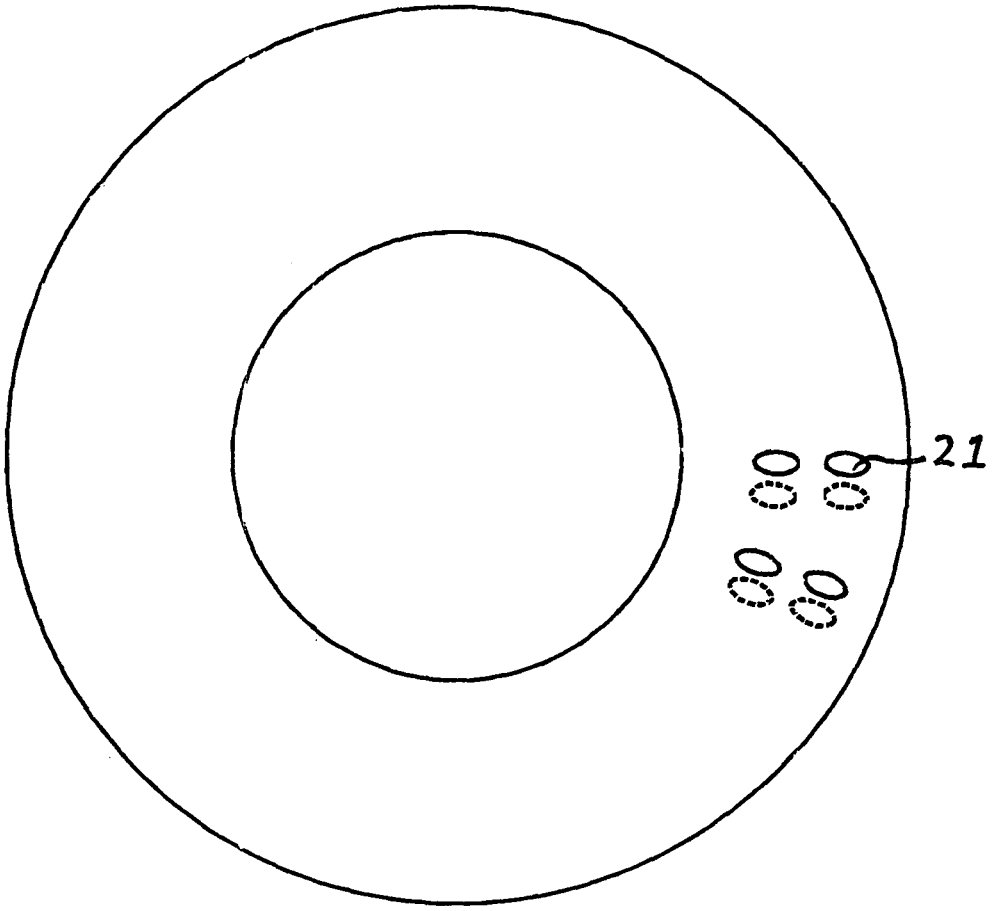
FIG. 6 shows a top view of the gas cutoff according to still another possible embodiment.
Figure 7:
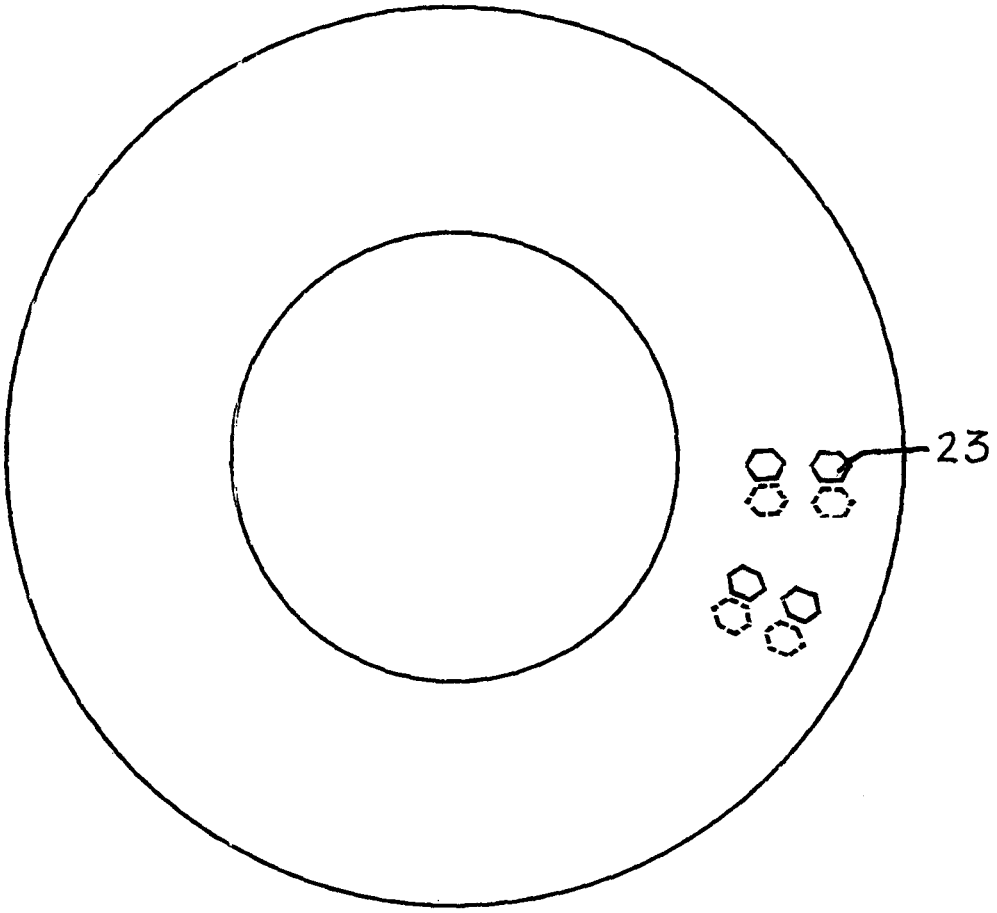
FIG. 7 shows a top view of the gas cutoff according to another possible embodiment.
Figure 8:
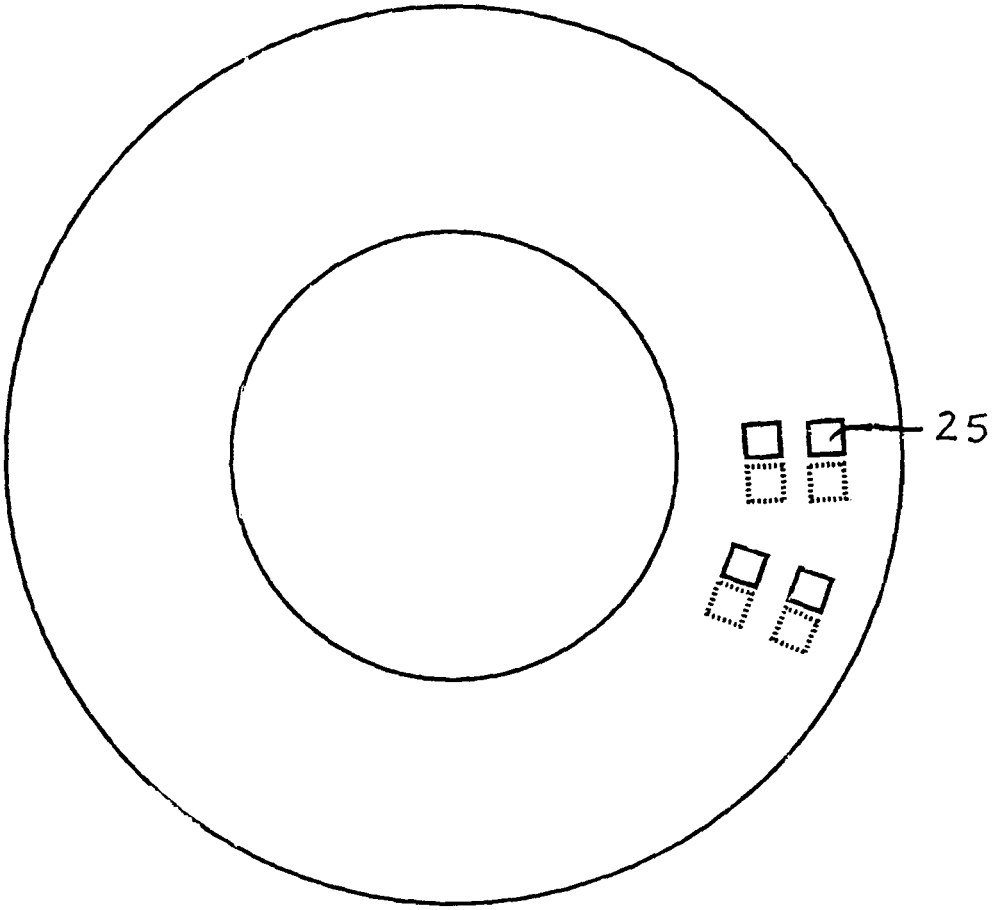
FIG. 8 shows a top view of the gas cutoff according to yet another possible embodiment.
Figure 9:
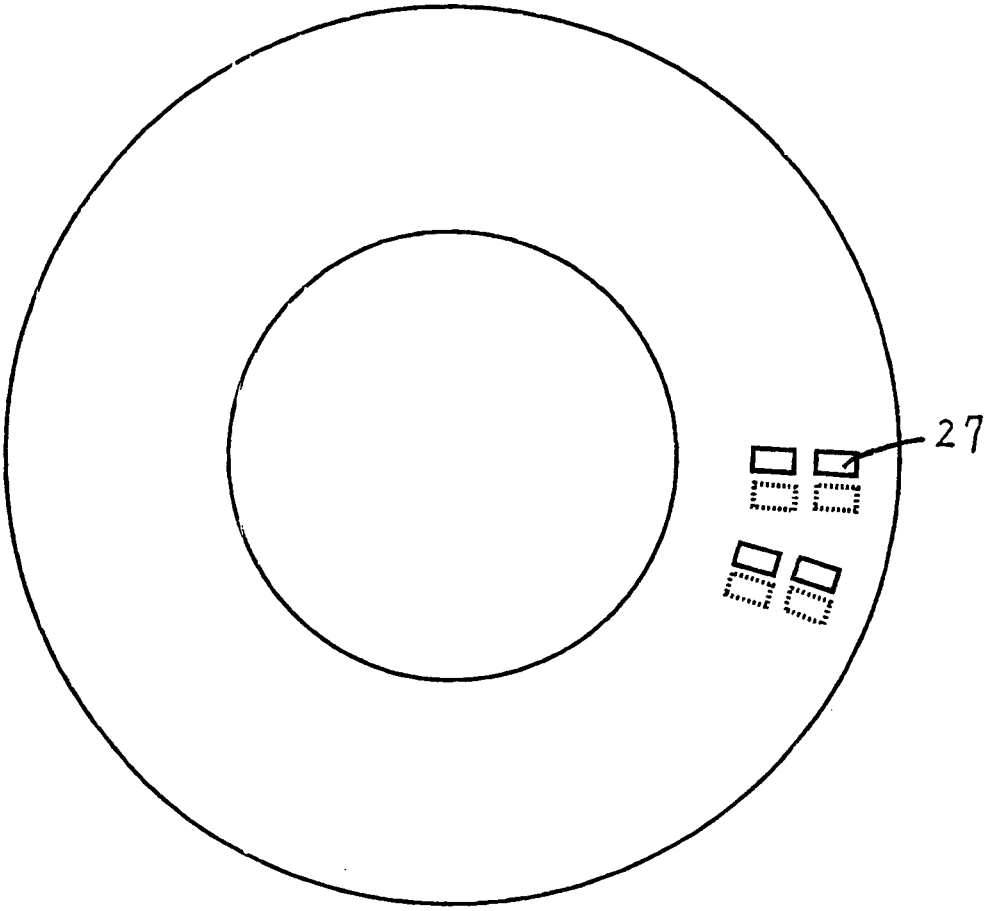
FIG. 9 shows a top view of the gas cutoff according to still another possible embodiment.

FIGS. 6 to 9 show top views of different embodiments of the gas cutoff 13, having different shaped passages. FIG. 6 shows ellipse-shaped passages 21. FIG. 7 shows hexagonally-shaped passages 23. Please note that any polygonal shape may be used for the passages, such as triangles, pentagons, heptagons, octagons, decagons, etc. FIG. 8 shows square-shaped passages 25. FIG. 9 shows rectangular passages 27. FIGS. 6 to 9 show two sets of passages for illustrative purposes, and it is to be understood that any number of additional passages could be included in different possible embodiments. In at least one embodiment, the passages as shown in FIGS. 6 to 9 could continue about the entirety of the gas cutoff.

Figure 10:
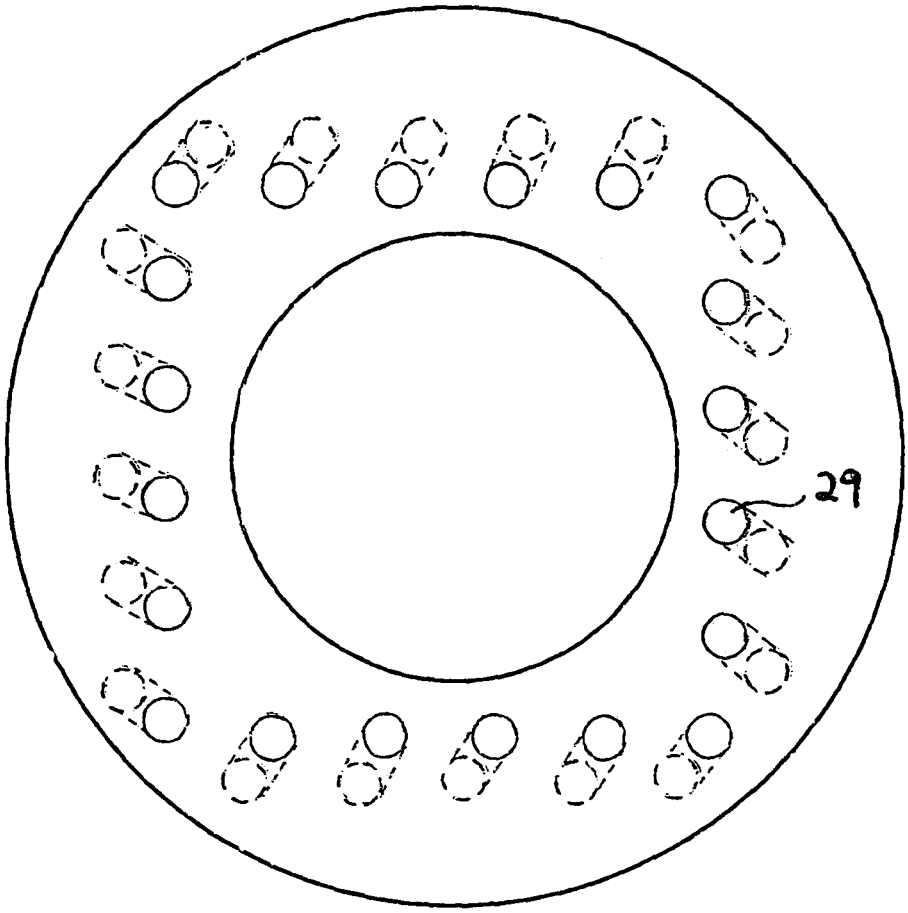
FIG. 10 shows a top view of the gas cutoff according to another possible embodiment.

FIG. 10 shows a top view of another possible embodiment of the gas cutoff 13. In this possible embodiment, the circular passages 29 are arranged linearly about the gas cutoff 13. The passages 29 run in a single file line on each side of the gas cutoff 13, such that they essentially form the shape of a square. FIG. 10 shows the passages 29 angled diagonally toward the inside walls of the filling valve and the container 1. However, the passages 29 may also be angled such that the open top end of each passage and the open bottom end of each passage lie on the same line.

Figure 11:
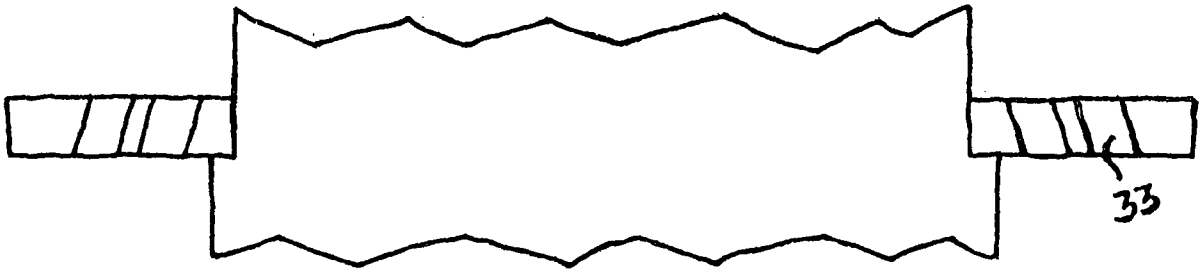
FIG. 11 shows a side cross sectional view of the gas cutoff according to one possible embodiment.
Figure 12:
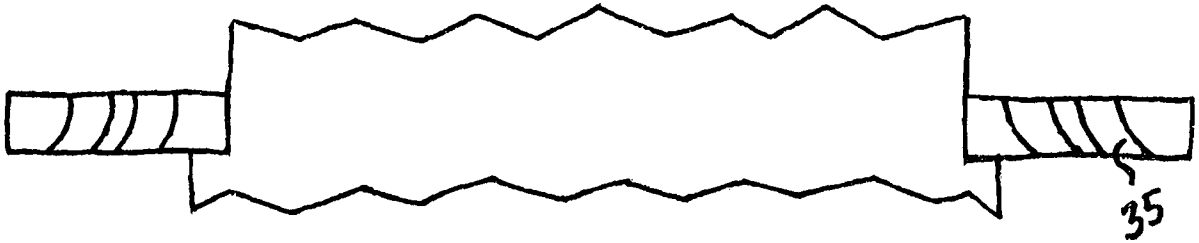
FIG. 12 shows a side cross sectional view of the gas cutoff according to yet another possible embodiment.

FIG. 11 shows a side cross sectional view of one possible embodiment of the gas cutoff 13. In this possible embodiment, the passages 33 are angled toward the inside walls of the filling valve and the container 1. The inner walls of the passages through which liquid beverage flows during filling are straight and linear in this embodiment. FIG. 12 is similar to FIG. 11, but shows an embodiment where the passages 35 are curved.

Figure 13:
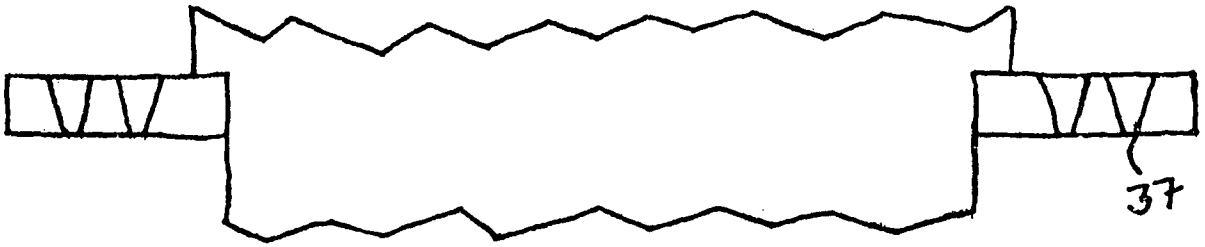
FIG. 13 shows a side cross sectional view of the gas cutoff according to still another possible embodiment.
Figure 14:
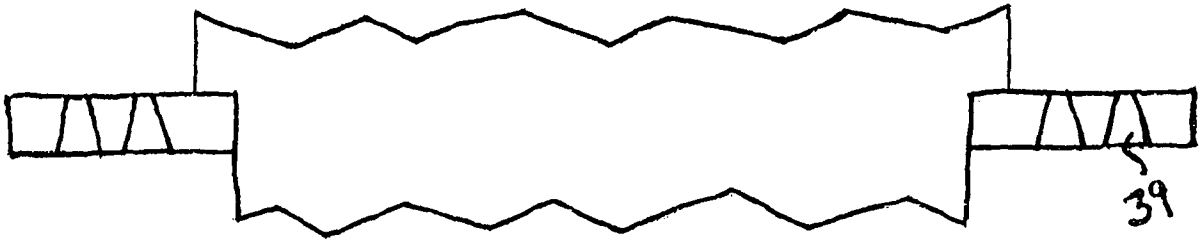
FIG. 14 shows a side cross sectional view of the gas cutoff according to another possible embodiment.

FIG. 13 shows a side cross sectional view of another possible embodiment of the gas cutoff 13. In this possible embodiment, the passages 37 are conically shaped. In other words, the open top ends of the passages 37 have a wider diameter than the open bottom ends. Conversely, FIG. 14 shows another possible embodiment with conical passages 39, wherein the open top ends of the passages 39 have a smaller diameter than the open bottom ends.

Figure 15:
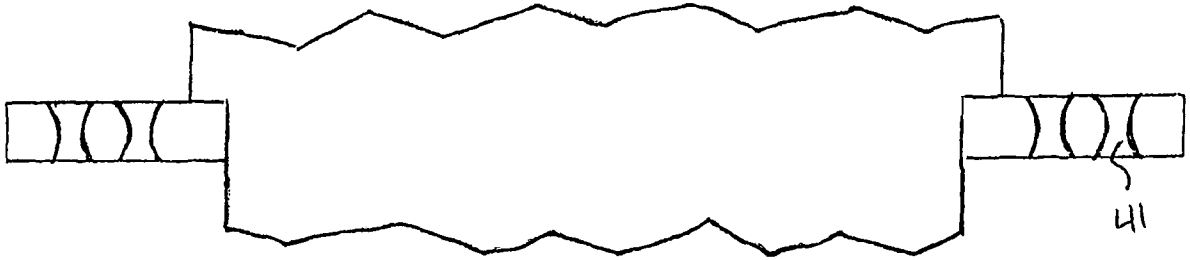
FIG. 15 shows a side cross sectional view of the gas cutoff according to yet another possible embodiment.

FIG. 15 shows a side cross sectional view of another possible embodiment of the gas cutoff 13. In this possible embodiment, the inner walls of the passages 41 are substantially hourglass-shaped. In other words, the diameter of the open top ends and the open bottom ends of the passages 41 are substantially equal, but the inner walls of the passages have a substantially smaller diameter at the center of the passages than at the open top ends and bottom ends.

Figure 16:
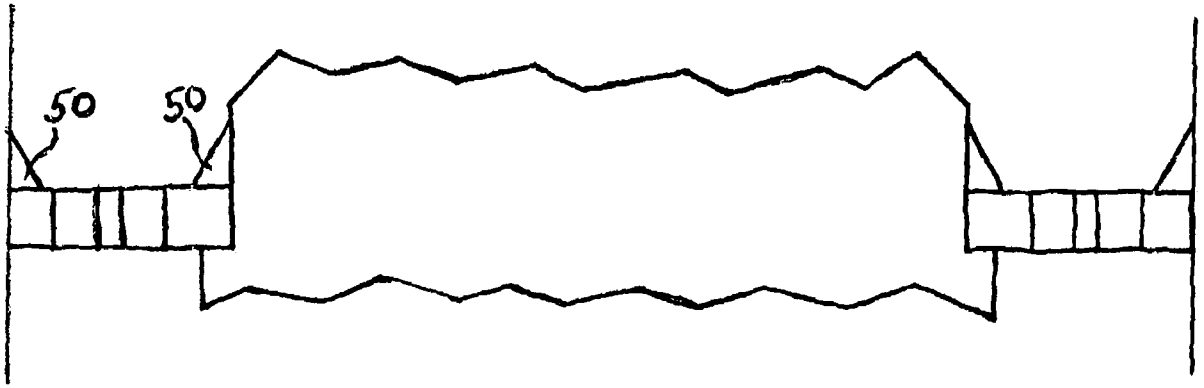
FIG. 16 shows a side cross sectional view of the gas cutoff according to still another possible embodiment.
Figure 17:
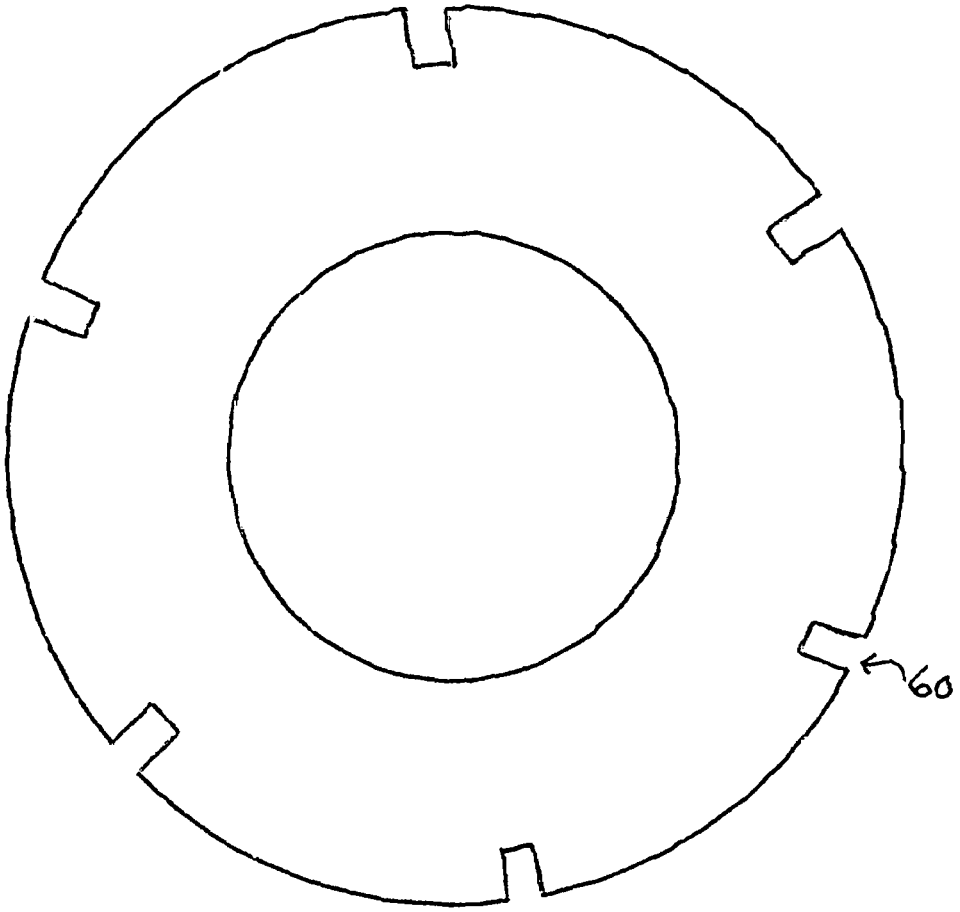
FIG. 17 shows a top view of the gas cutoff according to another possible embodiment.

FIG. 16 shows a side cross sectional view of another possible embodiment of the gas cutoff. In this possible embodiment, the top of the gas cutoff 13 comprises a cone-shaped or funnel-shaped top portion 50. FIG. 17 shows a top view of another possible embodiment of the gas cutoff 13. In this possible embodiment, the gas cutoff 13 comprises fin-shaped recesses 60 which at least partly interrupt the radial outer contour or peripheral surface of the gas cutoff 13. FIG. 17 shows an embodiment with six recesses 60 for exemplary purposes, and embodiments with more or fewer recesses are within the scope of the present application. The additional embodiments of the gas cutoff disclosed herein could also be modified to include the recesses 60.

Figure 18:
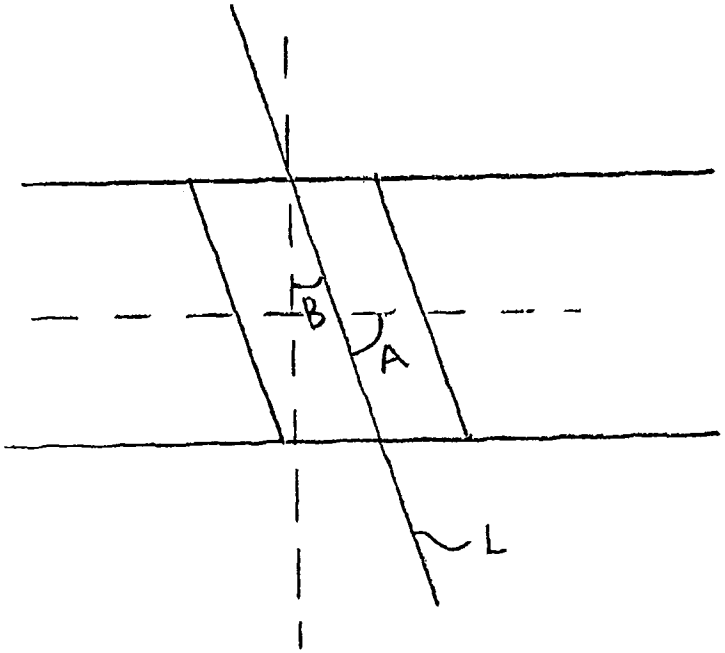
FIG. 18 shows a side cross sectional view of an angled passage.

FIG. 18 shows a side cross sectional view of an example of a passage 15. The passage 15 can be disposed in the gas cutoff 13 at an angle, represented in FIG. 18 by angles A and B. The angle A is defined by a line L along the central axis of the passage and a radius of the gas cutoff 13, which angle A could be between 45° and 90°, including numbers in tenths of a percent, such as, for example, 45.1°, 45.2°, 45.3°, 45.4°, 45.5°, 45.6°, 45.7°, 45.8°, 45.9°, 50.0°, etc. The angle B is defined by the line L and a line perpendicular to a radius of the gas cutoff 13, which angle B could be between 0° and 60°, including numbers in tenths of a percent, such as, for example, 0.1°, 0.2°, 0.3°, 0.4°, 0.5°, 0.6°, 0.7°, 0.8°, 0.9°, 1.0°, etc. The angle of the passages 15 can be selected to cause the liquid beverage to flow out of the gas cutoff 13 in a circular or swirling motion in order to avoid liquid entering the gas return tube, to minimize filling time, and to minimize gas bubbling back up through the passages 15.

The present application relates to a filling valve for the bottling of liquids in bottles, cans and similar containers with a closable liquid duct and a gas cutoff associated with said liquid duct with a swirl effect, in which the gas cutoff is realized in the form of a flat, plane element.

One feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling elements for filling beverage bottles with liquid beverage material; at least one liquid reservoir being configured to hold a liquid to be bottled; said at least one liquid reservoir comprising a gas headspace being disposed above a liquid to be bottled within said at least one liquid reservoir; at least one supply line being configured and disposed to connect said at least one liquid reservoir to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotor being configured and disposed to carry said plurality of filling elements about its periphery; each of said filling elements comprising: a dispensing opening being configured and disposed to permit the flow of liquid through said dispensing opening and into a bottle to be filled; a liquid duct being configured and disposed to permit the flow of liquid from said liquid reservoir; a housing being configured and disposed to house said liquid duct; a return gas tube comprising an open bottom end being disposed adjacent said dispensing opening; said return gas tube being configured and disposed to permit the flow of gas from a bottle being filled with a liquid beverage; a gas cutoff element, comprising: a substantially disk-shaped body portion being disposed about said liquid duct; said substantially disk-shaped body portion being substantially flat; a plurality of passages being configured and disposed to permit the flow of liquid beverage through said gas cutoff element; said passages being disposed in a substantially circular pattern around said gas cutoff element; said passages comprising an inlet portion, an outlet portion, and an inner wall portion; said outlet portion being vertically offset from said inlet portion; said inner wall portion being disposed between said inlet portion and said outlet portion; said passages being configured and disposed to permit the flow of liquid beverage such that liquid beverage exits said passages in a circular or swirling motion; said passages having a size, shape, angle, diametrical dimension, cross section, and inner contour to utilize and being configured and disposed to utilize the Coriolis effect; said passages being configured to take into account the latitude of the hemispheric location of the bottling plant, the viscosity of the liquid being bottled, the size and amount of solid matter in the liquid to be bottled, the temperature of the liquid to be bottled, and the type of bottle being filled; said passages being configured and disposed to minimize gas bubbling back up through said passages, to minimize entry of liquid into said gas return tube, and to minimize filling time.

Another feature or aspect of an embodiment is believed at the time of the filing of this patent application to possibly reside broadly in a filling machine for filling bottles, cans, or similar containers with a liquid comprising a filling valve, said filling valve comprising: a return gas tube comprising an open bottom end being disposed adjacent said dispensing opening; said return gas tube being configured and disposed to permit the flow of gas from a bottle being filled with a liquid beverage; a closable liquid duct being configured and disposed to permit the flow of liquid beverage into a bottle to be filled; a gas cutoff element, comprising: a substantially flat, substantially disk-shaped body portion being disposed about said closable liquid duct; at least one passage being configured and disposed to permit the flow of liquid beverage through said gas cutoff element such that liquid beverage exits said at least one passage in a circular or swirling motion; said at least one passage being configured and disposed to minimize gas bubbling back up through said at least one passage, and to minimize entry of liquid into said gas return tube during filling.

Yet another feature or aspect of an embodiment is believed at the time of the filing of this patent application to possibly reside broadly in a filling machine for filling bottles, cans, or similar containers with a liquid comprising a valve, said valve comprising: a closable liquid duct being configured and disposed to control the flow of liquid into a container to be filled; a gas cutoff element being configured and disposed to effect a swirling of liquid in said closable liquid duct; and said gas cutoff element comprising a substantially flat, planar element.

Another feature or aspect of an embodiment is believed at the time of the filing of this patent application to possibly reside broadly in a filling valve for the bottling of liquids in bottles, cans or similar containers with a closable liquid duct and a gas cutoff with a swirl action associated with said liquid duct, characterized by the fact that the gas cutoff is realized in the form of a flat, plane element.

Another feature or aspect of an embodiment is believed at the time of the filing of this patent application to possibly reside broadly in a filling valve, characterized by the fact that the gas cutoff is provided with passages.

Yet another feature or aspect of an embodiment is believed at the time of the filing of this patent application to possibly reside broadly in a filling valve, characterized by the fact that the gas cutoff is provided with recesses.

Still another feature or aspect of an embodiment is believed at the time of the filing of this patent application to possibly reside broadly in a filling valve, characterized by the fact that the passages and/or recesses or their side surfaces are at an inclination with respect to the vertical.

A further feature or aspect of an embodiment is believed at the time of the filing of this patent application to possibly reside broadly in a filling valve, characterized by the fact that the inclination is realized as a function of the circumference of an imaginary circle around the valve axis.

Another feature or aspect of an embodiment is believed at the time of the filing of this patent application to possibly reside broadly in a filling valve, characterized by the fact that the inclination in the direction of flow is directed radially outward.

Yet another feature or aspect of an embodiment is believed at the time of the filing of this patent application to possibly reside broadly in a filling valve, characterized by the fact that the inclination is realized as a function of the location in which the filling machine will be used so that the Coriolis effect is utilized and positively assisted.

Still another feature or aspect of an embodiment is believed at the time of the filing of this patent application to possibly reside broadly in a filling valve, characterized by the fact that the passages or recesses run in a straight line.

A further feature or aspect of an embodiment is believed at the time of the filing of this patent application to possibly reside broadly in a filling valve, characterized by the fact that the passages or recesses do not run in a straight line.

Another feature or aspect of an embodiment is believed at the time of the filing of this patent application to possibly reside broadly in a filling valve, characterized by the fact that the upper side of the gas cutoff is at least partly in the shape of a funnel or cone.

Yet another feature or aspect of an embodiment is believed at the time of the filing of this patent application to possibly reside broadly in a filling valve, characterized by the fact that the installation space for the gas cutoff is realized so that the filling valve is suitable to hold gas cutoffs of different thicknesses.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

All, or substantially all, of the components and methods of the various embodiments may be used with at least one embodiment or all of the embodiments, if more than one embodiment is described herein.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the patents, patent applications and publications recited herein, and in the Declaration attached hereto, are hereby incorporated by reference as if set forth in their entirety herein.

Some examples of pneumatic arrangements that may possibly be utilized or possibly adapted for use in at least one possible embodiment of the present application may possibly be found in the following U.S. patents: U.S. Pat. No. 6,609,767 issued to Mortenson et al. on Aug. 26, 2003; U.S. Pat. No.

6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of seal arrangements that may possibly be utilized or possibly adapted for use in at least one possible embodiment of the present application may possibly be found in the following U.S. patents: U.S. Pat. No. 5,411,273 issued to Pietsch et al. on May 2, 1995; U.S. Pat. No. 6,290,234 issued to Berle et al. on Sep. 18, 2001; U.S. Pat. No. 6,474,653 issued to Hintenlang et al. on Nov. 5, 2002; U.S. Pat. No. 6,616,146 issued to Friend et al. on Sep. 9, 2003; U.S. Pat. No. 6,692,007 issued to Oldenburg on Feb. 17, 2004; and U.S. Pat. No. 6,648,335 issued to Ezell on Nov. 18, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Some examples of nozzle structures that may possibly be utilized or possibly adapted for use in at least one possible embodiment of the present application may possibly be found in the following U.S. patents: U.S. Pat. No. 6,042,026 issued to Buehler, II on Mar. 28, 2000; U.S. Pat. No. 6,394,366 issued to Adams on May 28, 2002; U.S. Pat. No. 6,402,062 issued to Bendig et al. on Jun. 11, 2002; U.S. Pat. No. 6,616,072 issued to Harata et al. on Sep. 9, 2003; U.S. Pat. No. 6,666,386 issued to Huang on Dec. 23, 2003; and U.S. Pat. No. 6,681,498 issued to Steffan on Jan. 27, 2004.

The sentence immediately above relates to patents, published patent applications and other documents either incorporated by reference or not incorporated by reference.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The corresponding foreign and international patent publication applications, namely, Federal Republic of Germany Patent Application No. 10 2004 022 096.4, filed on May 5, 2004, having inventor Dieter-Rudolf Krulitsch, and DE-OS 10 2004 022 096.4, and DE-PS 10 2004 022 096.4, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A container filling machine filling valve arrangement comprising:

a valve being configured and disposed to control the flow of liquid from a liquid source into a container to be filled;

an always-open gas cutoff element being configured to: permit flow of liquid through said gas cutoff element, prevent or minimize gas from flowing through said gas cutoff element, and generate a swirling of liquid flowing through said gas cutoff element; and said gas cutoff element comprising a substantially flat, planar element.

2. The container filling machine filling valve arrangement according to claim 1, wherein said gas cutoff element comprises passages and/or recesses, which are separated from one another, and with their side surfaces within said gas cutoff element being inclined relative to a vertical axis of the container filling machine filling valve arrangement to generate swirling of liquid along and about the vertical axis.

3. The container filling machine filling valve arrangement according to claim 2, wherein the inclination of said passages and/or recesses is a function of the circumference of a circle around the vertical axis.

4. The container filling machine filling valve arrangement according to claim 3, wherein each of said passages and/or recesses comprises an entry orifice and an exit orifice, which exit orifice is disposed radially further from the vertical axis than said entry orifice.

5. The container filling machine filling valve arrangement according to claim 4, wherein the surfaces of said passages and/or recesses are inclined, depending on the location of the container filling machine in which said filling valve arrangement is to be installed, such that the Coriolis effect is utilized to positively support swirling.

6. The container filling machine filling valve arrangement according to claim 5, wherein said side surfaces of said passages and/or recesses are one of: straight and nonlinear, from the input side to the output side of said gas cutoff element.

7. The container filling machine filling valve arrangement according to claim 6, wherein the top, liquid input side of the gas cutoff is at least partly in the shape of a funnel or cone.

8. The container filling machine filling valve arrangement according to claim 7, wherein the installation space for said gas cutoff element is configured to hold gas cutoff elements of different thicknesses.

9. The container filling machine filling valve arrangement according to claim 1, wherein said gas cutoff element comprises always-open openings configured to permit flow of liquid through said gas cutoff element and configured to prevent or minimize gas from flowing through said gas cutoff element.

10. The container filling machine filling valve arrangement according to claim 9, wherein said openings in said gas cutoff element are configured to prevent or minimize gas in a container to be filled from bubbling up through said gas cutoff element during filling of the container.

11. The container filling machine filling valve arrangement according to claim 10, wherein said openings comprise passages and/or recesses with their side surfaces within said gas cutoff element being inclined at an angle with respect to the direction of flow of liquid entering said gas cutoff element.

12. The container filling machine filling valve arrangement according to claim 11, wherein said openings are inclined to generate swirling of liquid along and about a vertical axis of the container filling machine filling valve arrangement.

13. The container filling machine filling valve arrangement according to claim 12, wherein each of said openings comprises an entry orifice and an exit orifice, which exit orifice is disposed radially further from the vertical axis than said entry orifice.

14. The container filling machine filling valve arrangement according to claim 13, wherein the surfaces of said passages and/or recesses are inclined, depending on the location of the container filling machine in which said filling valve arrangement is to be installed, such that the Coriolis effect is utilized to positively support swirling.

15. The container filling machine filling valve arrangement according to claim 14, wherein the liquid input side of the gas cutoff is at least partly in the shape of a funnel or cone.

16. The container filling machine filling valve arrangement according to claim 15, wherein said side surfaces of said passages and/or recesses are one of: straight and nonlinear, from the input side to the output side of said gas cutoff element.

17. The container filling machine filling valve arrangement according to claim 16, wherein the angle of inclination of said passages and/or recesses is dependent upon the location of said passages and/or recesses about the center of said gas cutoff element.

18. The container filling machine filling valve arrangement according to claim 17, wherein said passages and/or recesses are disposed in a substantially circular pattern about said gas cutoff element.

19. The container filling machine filling valve arrangement according to claim 18, wherein the installation space for said gas cutoff element is configured to hold gas cutoff elements of different thicknesses.

20. The container filling machine filling valve arrangement according to claim 9, wherein said openings comprise passages and/or recesses, the surfaces of which are inclined, depending on the location of the container filling machine in which said filling valve arrangement is to be installed, such that the Coriolis effect is utilized to positively support swirling.

* * * * *